US005469182A

United States Patent [19]

Chaffee

[11] Patent Number: 5,469,182

[45] Date of Patent: Nov. 21, 1995

[54] ANTENNA DRIVE ASSEMBLY

[75] Inventor: Frank Chaffee, Spring Green, Wis.

[73] Assignee: Orbitron Division of Greenbriar Products, Inc., Spring Green, Wis.

[21] Appl. No.: 109,806

[22] Filed: Aug. 20, 1993

[51] Int. Cl.[6] ..... H01Q 3/04

[52] U.S. Cl. ..... 343/882; 248/183.4; 343/766

[58] Field of Search ..... 343/840, 757, 343/765, 766, 880, 882; 248/183, 185; H01Q 3/00, 3/04, 3/08

[56] References Cited

U.S. PATENT DOCUMENTS

| | | | |
|---|---|---|---|
| 3,229,941 | 1/1966 | Suliteanu et al. | 343/765 |
| 3,515,015 | 6/1970 | Gilbert | 343/765 |
| 3,546,704 | 12/1970 | Selby et al. | 343/765 |
| 4,197,548 | 4/1980 | Smith et al. | 343/765 |
| 4,204,214 | 5/1980 | Fassnacht | 343/766 |
| 4,598,297 | 7/1986 | Hawkins | 343/882 |
| 4,602,259 | 7/1986 | Shepard | 343/882 |
| 4,783,662 | 11/1988 | Wirth, Jr. et al. | 343/757 |
| 4,814,781 | 3/1989 | DeHaven | 343/766 |
| 4,821,047 | 4/1989 | Williams | 343/882 |
| 4,918,363 | 4/1990 | Hollis et al. | 343/765 |
| 5,077,561 | 12/1991 | Gorton et al. | 343/882 |

*Primary Examiner*—Michael C. Wimer
*Attorney, Agent, or Firm*—Quarles & Brady

[57] ABSTRACT

A linear-actuator-type antenna drive assembly for use in an antenna base, which drive assembly facilitates horizon-to-horizon tracking of geosynchronous satellites, includes a linear actuator having an expandable and retractable end, a first link pivotably connected between the expansible and retractable end of the linear actuator and a means for mounting an antenna to the base, and a second link pivotably connected between the base and the first link.

13 Claims, 2 Drawing Sheets

ANTENNA DRIVE ASSEMBLY

FIELD OF THE INVENTION

The present invention is directed to an antenna drive assembly, and more particularly to a linear actuator style drive that enables 180° horizon-to-horizon dish motion.

BACKGROUND OF THE INVENTION

Satellites that orbit the earth in the equatorial plane at an altitude of 6.611 earth radii are geosynchronous, or relatively fixed above a particular point on earth. Since all geosynchronous satellites are in the equatorial plane (celestial latitude=0°), the location of a particular satellite is unambiguously designated by its longitude. For example, geosynchronous satellites located on an arc between approximately 70° West longitude and 135° West longitude provide coverage for the continental United States.

Earth-mounted dish antennas can receive data from any geosynchronous satellite within its longitudinal scope. It is relatively straightforward to direct a dish antenna to a particular geosynchronous satellite by rotating the receiving dish about its north-south polar axis. In addition, the parabolic reflector axis is then pointed toward the Clark Belt along the geosynchronous arc by adjusting the declination angle. Such systems operate on the theory that rotation about an axis which is normal to the plane passing through the site and two geosynchronous satellites will aim the antenna at the two satellites with minimal pointing error. At the equator, the polar axis is parallel to the surface of the earth, and the dish antenna, mounted to rotate about that axis, faces straight up. At non-equatorial installations, the angle of the polar axis is equal in magnitude to the latitude of the installation site. In the Northern Hemisphere, a dish antenna mounted to rotate about its polar axis faces South toward the celestial equator, while a dish in the Southern Hemisphere faces North toward the celestial equator. In each case, the polar axis of the dish is normal to the equatorial plane.

In a single axis system of the type described, a dish antenna can contact any geosynchronous satellite it can point to. At present, geosynchronous satellites positioned on the arc described above ring much of the earth, with approximately 4° of separation between each. As such, it is a goal of dish antenna designers to maximize the number of satellites a dish can track, by encompassing as much of the geosynchronous orbit arc as possible, up to the theoretical horizon-to-horizon sweep limit of 180°. While such dish antennas can sweep across a 180° arc, they can only point to satellites on a 162.6° arc, at the equator, and to smaller arcs at higher latitudes. These limits arise because of encounters with the horizon at either end of the arc.

At present, either of two fundamentally different dish antenna drive assembly types are used to orient a dish to desired longitudes. To date, only one of the two types can sweep out a horizon-to-horizon arc of 180°. Existing horizon-to-horizon assemblies rely upon either fine-tooth gearing or a system of chains and sprockets to move the dish across the 180° arc. While horizon-to-horizon type drives sweep out the largest possible arc, they are typically much more complex and expensive than linear actuator type drives.

Typical linear actuator drives have a moveable shaft pivotally connected at one end to the underside of the dish. The movable shaft is typically a screw jack operated manually or by motor drive that urges the mounted dish antenna around its polar axis. At most, the linear actuator type of drive assembly can sweep out an arc of about 110°, because of the mechanical constraints that arise from connecting the linear actuator directly to the dish and to the mount.

What is lacking, therefore, in the art is a dish antenna drive assembly that combines the simplicity and economy of existing linear actuator drives with the wide-range survey capability of existing horizon-to-horizon drives.

SUMMARY OF THE INVENTION

A linear actuator type dish antenna drive capable of directing 180° horizon-to-horizon tracking of the geosynchronous orbit arc along the equatorial plane comprises a first pivotable link between the dish antenna mount and the telescoping end of the linear actuator and a second pivotable link connected between the dish antenna base and the first pivotable link. The improved linear actuator drive disclosed herein provides a movable point about which the first link can pivot while continually urging the antenna about an axis, thereby maximizing both the mechanical advantage and the tracking range of the dish.

BRIEF DESCRIPTION OF THE DRAWINGS

In FIG. 1, the antenna is rotated to its maximal leftward (eastward) position.

FIG. 3 is taken from the perspective of the arrow numbered 3 in FIG. 1.

DETAILED DESCRIPTION OF THE INVENTION

Figure 1:
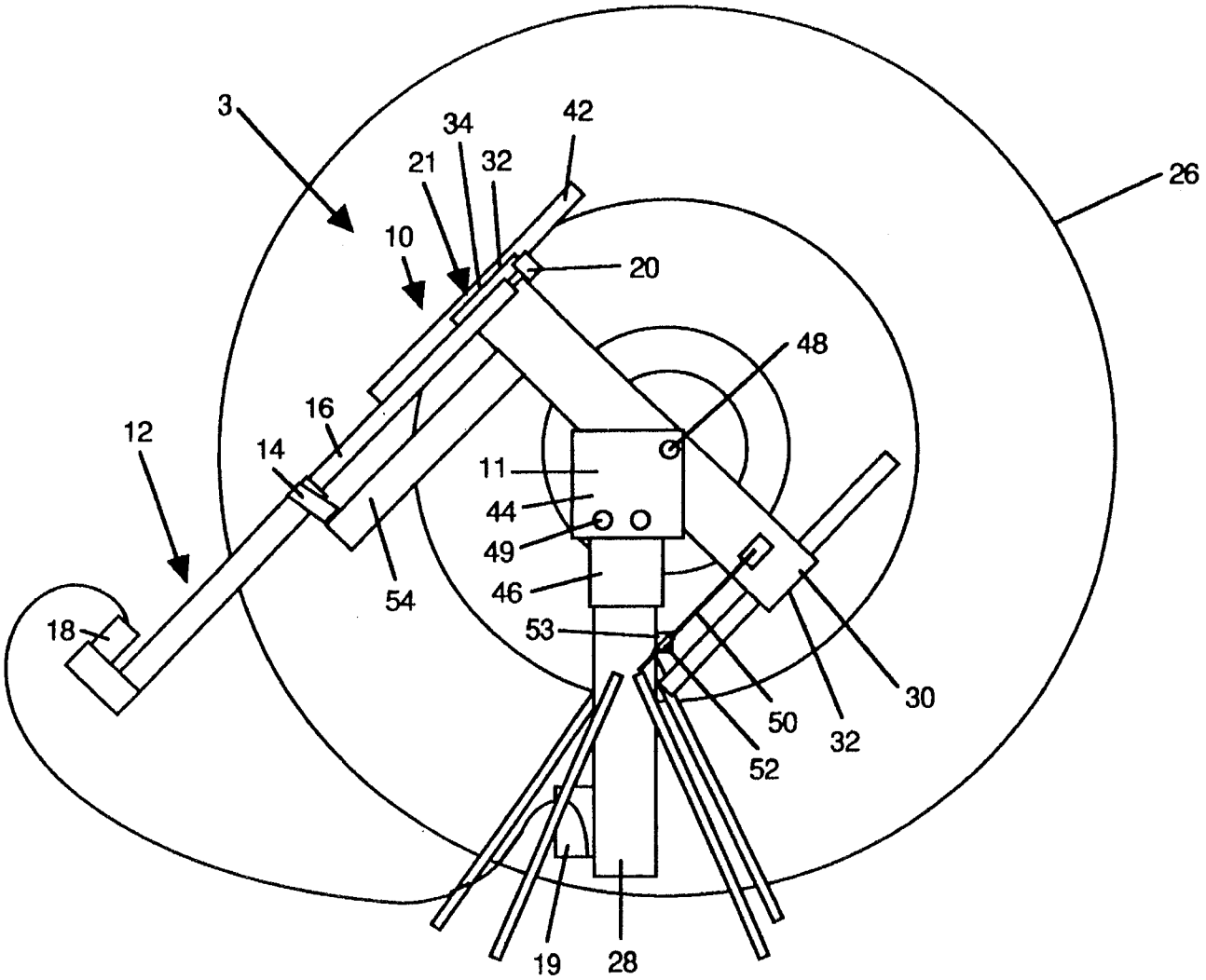
FIG. 1 shows a side view of a dish antenna mounted atop a base incorporating the drive assembly of the present invention.

The present invention is directed to a novel antenna drive assembly, based on a linear actuator, that permits a dish antenna to sweep out an arc of 180°, without requiring the complex and expensive drive components of existing horizon-to-horizon drive assemblies. The invention is intended to be used to rotate a mounted dish antenna 26 about a defined axis, where such axis is tangential to the focus of the parabola that defines the dish. FIG. 1 shows a dish antenna for reception or transmission mounted to an antenna base 11 that incorporates the drive assembly of the present invention. The drive assembly 10 is detailed in FIGS. 2 and 3, to which reference is now made.

The linear actuator 12 of the novel drive assembly is known to the art. As in other such drive assemblies, the linear actuator 12 has its lower end fixed in place pivotably mounted by a bracket 14 to a drive mounting arm 54, and this pivotal mounting allows the angular position of the linear actuator to vary. The linear actuator 12 includes an extensible and retractable portion 16 which extends from and is retracted into its lower fixed end. In response to a change in length of the linear actuator, the antenna is urged to rotate about its axis.

The linear actuator length may be operable manually, mechanically or, as in the preferred embodiment, by an electromechanical computer-controlled device, such as a DC drive motor 18 which is operated based on data from a Hall effect sensor, reed sensor, optical sensor, or potentiometer sensor, or the like, and is powered by a power supply 19. The sensors provide an appropriate feedback signal to a programmable positioner or controller. Such electromechanical devices are known to the art. One such device for driving a linear actuator is described in U.S. Pat. No. 4,918,363, which is incorporated herein by reference.

As an improvement to the existing state of the linear-actuator-type drive assembly art, the drive assembly of the present invention includes a first pivotable link 20 inserted between the far end of the extensible and retractable portion 16 of the linear actuator 12 and an axial rotating antenna mount 21, to gain mechanical advantage during rotation of the axial rotating mount 21 brought about by changing the length of the linear actuator 12. The axial rotating mount 21 rotates about the selected axis and provides support for a dish antenna mounted thereto. The axial rotating mount 21 is described in detail elsewhere in this specification. It is noted that while the preferred connection is to an axial rotating mount, direct connection of the first link 20 to the antenna is also possible. However, connection through the axial rotating mount lets one base support many different kinds of antennae (with appropriate mounting hardware being provided for each). In contrast, if the link 20 was connected directly to the antenna, it might be necessary to adjust the length or position of the first link for each antenna, to obtain the advantageous mechanical advantage provided by the present invention.

A second pivotable link 22, rotatably attached at one end to the antenna base, is pivotably connected at its other end to the first link 20, to maximize the mechanical advantage gained by the first link 20. The preferred connection to the first link is at or near the midpoint of the first link, although by varying the points at which both ends of the second link are connected, it may be possible to achieve 180° rotation using other configurations.

The first and second links 20, 22 are preferably formed of a weatherproof, durable material, such as metal, and should be capable of unimpeded rotation about the four pivot points. In the preferred embodiment, the first link 20 is formed of a spaced-apart pair of parallel flat metal bars having, at one end, a tongue 24 with an aperture. The linear actuator 12 is preferably pivotably connected to the tongue 24, while between the flat metal bars the axial support is attached at the other end to the axial rotating mount. The second link 22 is also pivotably fastened between the flat bars of the first link 20. Other connection schemes are possible.

The drive assembly of the present invention is intended to be used in conjunction with an axially-rotatable dish antenna. What follows is a detailed description of a dish antenna base fitted with the preferred embodiment of the present invention.

A dish antenna is typically affixed to an axial mount on a base secured to the ground or to a permanent or temporary pedestal. Most often, such mounts provide a single axis of rotation. When designing a drive assembly to track geosynchronous satellites, the single axis is preferably a polar axis tangential to the focus of the dish parabola. However, the invention is not intended to be so limited. While the linear actuator type drive assembly disclosed herein is described in conjunction with a mount providing a single polar axis of rotation, two or more such drive assemblies could be employed simultaneously with an antenna designed to be positioned along two or more independent axes. Such an antenna could then access satellites in non-geosynchronous earth orbits. A dish mount incorporating two or more drive assemblies of the type disclosed herein could track a wider array of satellite orbits than a mount using existing linear actuator technology.

In FIG. 1, a dish antenna 26 is shown mounted to an antenna base 11, which includes a tubular four-legged base 28. The particulars of the base 28 to which an antenna may be mounted are not intended to limit this invention. Preferably, the base is also provided with a base positioner for installation at various latitudes, although a base designed for use at a single latitude would also be appropriate. One skilled in the art can also envision any number of means for stabilizing the base 28, which means are not intended to limit the present invention.

Figure 3:
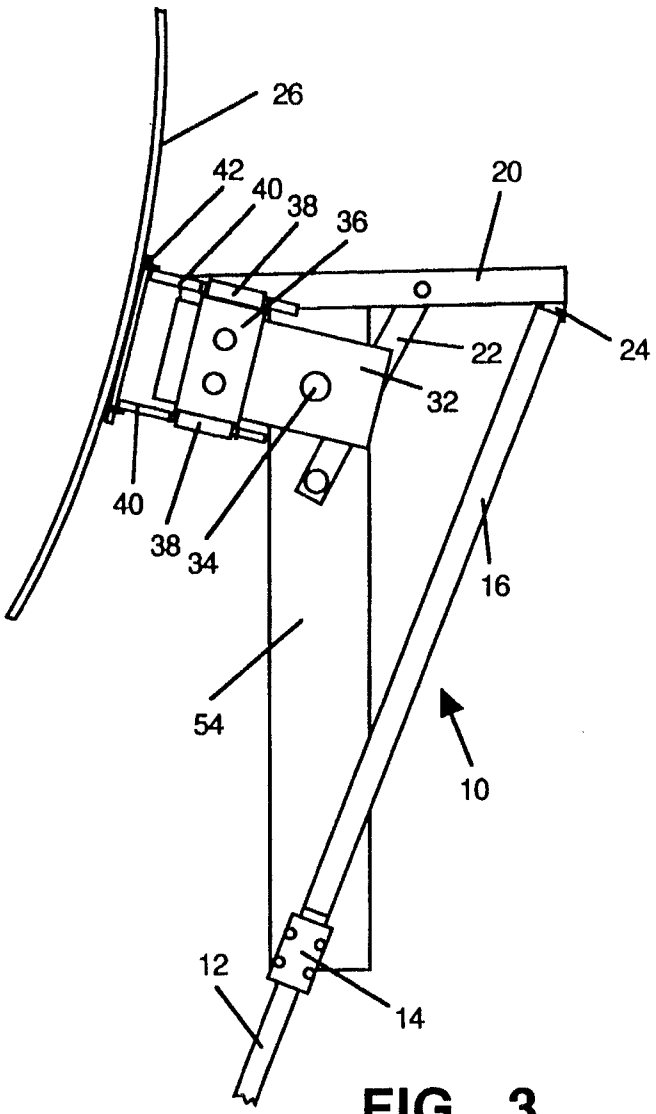
FIGS. 2 and 3 are detailed front views of the base taken from the left side of the device shown in FIG. 1. Shown in detail is the drive assembly of the present invention. The dish antenna is shown at its maximal rightward position in FIG. 2 and at its maximal leftward position in FIG. 3.
Figure 2:
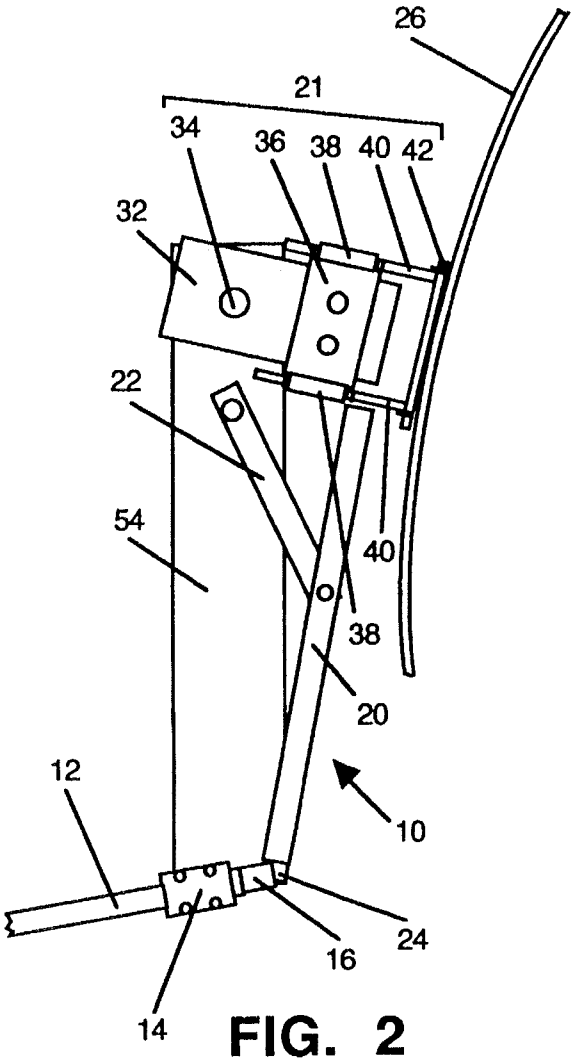

Attached at or near the top the base 28 is a pivotable axis member 30, shown in FIG. 1. As noted above, the preferred axis of rotation is the north-south polar axis, since the preferred embodiment of the invention is presented herein in conjunction with an antenna for tracking geosynchronous satellites, but the base must allow for use of the antenna at different latitudes. The axis member 30, having first and second ends, may assume any size or shape that allows pivoting to the proper angle for a given latitude, and should be rigid enough to support the weight of the antenna dish mounted as described herein. The axis member 30 is connected to the axial rotating mount 21, which includes a support plate 32 of an elongated, inverted U-shape, with rectangular ends and top. The support plate 32 is also preferably provided with coaxial apertures through its first and second ends for attachment to the axis member 30. A fastener 34 at one end of a shaft through the aperture is shown in FIGS. 2 and 3.

The axial rotating mount 21 includes upper and lower antenna mounting brackets, of a type known to the art. The brackets join the underside of the antenna dish, through the axis member 30, to the antenna base 11, so that the connected antenna dish can rotate about the axis. The invention is not intended to be limited to any particular connector, so long as 180° rotation of the mounted dish about the desired axis is unimpeded. When designing upper and lower connectors for both the base and the dish, attention should be paid to adequately distributing the weight of the rotating dish antenna to ensure that the base remains stable at all possible dish positions.

The two antenna mounting brackets of the rotating mount 21 do differ from each other in shape. Many possible upper and lower bracket designs exist; the invention is not limited to any particular bracket designs. Only the upper mounting bracket 36 is shown in the figures. The upper mounting bracket includes a mounting subassembly 38 having a pair of elevated tubular channels which receive a pair of threaded upper mounting bolts 40 connecting to a dish antenna upper mounting bracket 42. The dish antenna mounting bolts 40 are secured in the tubular channels by nuts at both channel ends. These elevated tubular channels and mounting bolts 40 together form a mechanism for setting the declination angle of the dish antenna. The lower bracket (i.e., closer to the ground), not shown, is provided with a tubular channel which engages a lower mounting bracket on the underside of the dish antenna and which is secured in place by passing a threaded lower mounting bolt through both the dish mounting bracket and the tubular channel and fixing nuts to the ends of the bolt.

As mentioned earlier the antenna base 11 includes a base positioning mechanism for orienting the base to an angle appropriate to the installation site latitude, such that the dish antenna connected to the oriented base sweeps out a desired arc in the sky when rotated about the selected axis. One of ordinary skill would be able to envision many positioners other than those described herein. It is, therefore, not a requirement of the present invention that the positioner be provided by the axis member 30, nor that the positioner be provided as described below.

In the preferred embodiment, the positioner includes an axis member mounting bracket 44, securely mounted between the axis member 30 and the vertical tubular portion of the base 28, which allows the axis member 30 to pivot vertically to achieve an angle equal to the installation site latitude. The mounting bracket may be formed of any strong, rigid and durable material, such as metal, that is capable of supporting the great weight of a rotating dish antenna. The sides of the bracket 44 are preferably formed of a pair of metal pieces, spaced apart by a distance sufficient to permit the axis member 30 to be pivotably secured therebetween at a pivot point. The bottom of the bracket 44 may be formed of a third metal piece welded or otherwise secured atop a tubular portion 46 having a sufficiently wide diameter that the entire mounting bracket 44 may be positioned atop the vertical portion of the tubular base 28 and secured with nuts and bolts or with other means for stably mounting the dish antenna.

The pivot point of the mounting bracket 44 is preferably delineated by a threaded shaft 48 that passes both through the linear midpoint of the axis member 30 and through side apertures in the axial support mounting bracket 44, which shaft 48 is secured at both ends with nuts after orienting the axis member 30. To maintain the rigid spaced-apart form of the bracket 44, one or more additional spacers 49 may also be securely provided between the sides, taking care not to impede the axis member pivot.

Axial restraints for fixing the oriented axial support to the proper position for the site latitude may also be provided. For example, at least one, but preferably a pair of, pivotable threaded rigid rods 50 connected to, and depending from, one end of the pivotable axis member 30 engage a latitude adjustment bracket 52 which is itself rotatably disposed through an aperture in a tongue 53 on a vertical side of the base 28. In the preferred embodiment, the latitude adjustment bracket 52 includes, at its ends, a pair of tubular channels which receive the threaded rods 50, which rods may be secured with nuts provided at both ends of each tubular channel. For ease of use, the horizontal distance between the tubular channels of the latitude adjustment bracket 52 equals the distance between the depending threaded rods 50. The precise means for connecting the threaded rods 50 to the axis member 30, and for securing the threaded rods 50 in the latitude adjustment bracket 52 are many and varied, and are not intended to limit the present invention.

The base also preferably includes a drive assembly mount for attaching the drive assembly of the present invention to the base, although it may be possible to attach the drive assembly to another portion of the base. In the preferred embodiment, the drive assembly mount is provided by a drive mounting arm 54 that fixedly depends at about a 90° angle from the upper end of the axis member 30. The outer portion of the linear actuator 12 is attached by the bracket 14 to the end of the mounting arm 54 farthest from the antenna 26.

In describing the novel drive assembly 10 of the present invention, it was noted above that the first link 20 is positioned between the axial rotating mount and the extensible and retractable end 16 of the linear actuator portion 12 of the drive assembly 10. It was also noted that the first link 20 is further provided with a connection point preferably at or near its midpoint, which connection point serves as the point of pivotable connection to one end of the second link 22. At this juncture, the preferred connections of the linear actuator 12 and the second link 22 to the mounting arm 54 of the base 28 are now detailed, which connections enable the drive assembly 10 to function as intended.

At the distal end of the drive mounting arm 54 (i.e., the end positioned away from the axis member 30), pivotable connection is made with the linear actuator bracket 14, such that the angular position of the linear actuator may vary as its length changes. Also, the free end of the second link 22 is pivotably connected to the drive mounting arm 54 at an optimal position that is empirically determined geometrically to give the 180° travel required using a given stroke length of the linear actuator.

In use to track geosynchronous satellites, the antenna base 28 is positioned at the desired installation site by a two-step alignment. First, the axis member 30 is aligned toward true north (Northern Hemisphere) or true south (Southern Hemisphere). Next, the drive mounting arm end of the axis member 30 is elevated from the horizontal to an angle equal in magnitude to the installation site latitude. This may be accomplished by first loosening the latitude adjustment bracket 52 and the pivot point shaft 48 that passes through the axis member 30 and its mounting bracket 44. The desired angle is fixed by re-tightening both the latitude adjustment bracket 52 and the pivot point shaft 44. Next the declination angle is set by adjusting the mounting bolts 40 in the tubular channels of the upper mounting bracket 36. The declination angle setting depends upon the design of a mount and may be determined by one of ordinary skill. Necessary setting guides are typically provided by the manufacturer.

After having thus installed the base 28, oriented the axis member 30 to the polar axis and adjusted the declination and elevation angles, the dish antenna 26 mounted to the installed base 28 will rotate about the polar axis and in so doing will sweep out an arc upon which the geosynchronous satellites lie.

In accord with the present invention, the dish antenna is moved by changing the length of the linear actuator 12. In the preferred embodiment, the length of the linear actuator 12 is changed by sending a digital signal to the controlling motor 18 which extends or retracts portion 16 of the actuator 12 as described above. When the actuator 12 is in its smallest or most retracted position, as illustrated in FIG. 2, the first link 20 closely abuts, and roughly parallels, the drive mounting arm 54, placing the dish antenna at its maximum rightward position, when facing the drive assembly 10. As the actuator arm 16 extends, mechanical force is exerted across the first link 20 to the upper end of the axial support 30, attached to the other end of the first link 20.

Continued extension of the linear actuator 12 further urges the axial support 32 leftward about the polar axis until such point as the first link 20 pivots about the attached second link 22. At that point, further extension of the linear actuator 16 pivots the second link 22, all the while continuing to drive the antenna dish leftward at the urging of the first link 20.

At the farthest extension point, both the first and second links 20 and 22 are maximally pivoted, as is shown in FIG. 3. Since the linear actuator 16 and the two links 20, 22 all pivot, the drive assembly 10 of the present invention can direct rotation to angles well beyond those achieved by the restrained linear actuators type drive assemblies of the prior art.

The dish antenna drive herein disclosed, with its novel pair of mechanical pivotable links incorporated into a linear actuator type drive assembly, meets a great need in the dish antenna industry. Whereas formerly only complex and expensive drive mechanisms could achieve horizon-to-horizon reception, the drive described herein allows such broad coverage while adding just a few simple mechanical parts. Coverage is expanded by a full 70° C. over the 110° range provided by earlier linear actuator type drives, permitting a dish to track as many as six to ten additional geosynchronous satellites.

The invention is not limited to the embodiment disclosed herein, but is intended to encompass all such modifications and variants as fall within the scope of the following claims.

I claim:

1. An antenna drive assembly for rotating an antenna about an axis of rotation, the drive assembly adapted for use with an antenna base assembly located at a latitude on earth, the antenna base assembly including a vertically oriented base, a pivotable axis member pivotably secured to the base at an adjustable angle based on the latitude; a driving arm extending from the axis member; and an axial rotating mount connecting the axis member to the antenna such that the antenna can be rotated about an axis of rotation extending through the connection between the axial rotating mount and the axis member, the drive assembly comprising:

a linear actuator pivotably mounted to the driving arm, the linear actuator having at one end an extensible and retractable portion, a first link pivotably connected at one end to the extensible and retractable portion of the linear actuator and pivotably connected at the other end to the axial rotating mount; and a second link pivotably connected at one end to the driving arm and pivotably connected at the other end to the first link, such that the first and second links cause the antenna to be rotated through a greater sweep of the sky than would be possible if the linear actuator connected directly to the axial rotating mount.

2. An antenna drive assembly as claimed in claim 1 wherein the antenna is a dish antenna.

3. An antenna drive assembly as claimed in claim 1 wherein the extent of rotation about the axis is greater than about 110°.

4. An antenna drive assembly as claimed in claim 3 wherein the extent of rotation about the axis is about 180°.

5. An antenna drive assembly as claimed in claim 1 wherein the length of the linear actuator is varied by an electromechanical device.

6. An antenna drive assembly as claimed in claim 5 wherein the electromechanical device is a DC motor under computer control.

7. An apparatus for rotating an antenna about an axis of rotation, the apparatus located at a particular latitude on earth, the apparatus comprising:

a vertically oriented base;

a pivotable axis member pivotably secured to the base at an adjustable angle based on the latitude;

a driving arm extending from the pivotable axis member;

an axial rotating antenna mount connecting the axis member to the antenna, the connection between the axis member and the antenna being such that the antenna can rotate relative to the axis member about an axis of rotation extending through the connection between the axial rotating mount and the axis member;

a dish antenna drive assembly mounted on the base, the drive assembly comprising a linear actuator pivotably mounted on the driving arm, the actuator having at one end an extensible and retractable portion;

a first link pivotably connected at one end to the extensible and retractable portion of the linear actuator and pivotably connected at the other end to the axial rotating antenna mount, and a second link pivotably connected at one end to the driving arm of the axis member and pivotably connected at the other end to the first link.

8. An apparatus as claimed in claim 7 wherein the antenna is a dish antenna.

9. An apparatus as claimed in claim 7 wherein the extent of rotation about the axis is greater than about 110°.

10. An apparatus as claimed in claim 9 wherein the extent of rotation about the axis is about 180°.

11. An apparatus as claimed in claim 7 further comprising a latitude adjustment bracket connected to the base and at least one threaded rod depending from the axis member, the threaded rod engaging the latitude adjustment bracket so that adjustments of the threaded rod adjust the angle of tilt of the axis member.

12. An antenna drive assembly as claimed in claim 7 wherein the length of the linear actuator is varied by an electromechanical device.

13. An antenna drive assembly as claimed in claim 12 wherein the electromechanical device is a DC motor under computer control.

* * * * *